United States Patent [19]

Wakita

[11] 3,948,044

[45] Apr. 6, 1976

[54] EXHAUST GAS PURIFYING DEVICE

[75] Inventor: Nobuaki Wakita, Susono, Japan

[73] Assignee: Toyota Jidosha Kogyo Kabushiki Kaisha, Toyota, Japan

[22] Filed: Apr. 26, 1974

[21] Appl. No.: 464,442

[30] Foreign Application Priority Data

Aug. 27, 1973 Japan ..... 48-95181

[52] U.S. Cl. ..... 60/278; 60/305

[51] Int. Cl.[2] ..... F02M 25/06; F01N 3/10

[58] Field of Search ..... 60/304, 305, 278

[56] References Cited

UNITED STATES PATENTS 3,580,232 5/1971 Sarto ..... 60/278

3,785,153 1/1974 Schwing ..... 60/305

*Primary Examiner*—Douglas Hart

*Attorney, Agent, or Firm*—Stevens, Davis, Miller & Mosher

[57] ABSTRACT

An exhaust gas purifying device wherein exhaust ports in the respective cylinders of an engine communicate with the respective inflow passages of a thermal reactor, and more secondary air flows into the inflow passage at the part of the thermal reactor with sufficient thermal diffusion than into another inflow passage.

Further, a taking-out port for the exhaust gas to be recirculated is provided at the exhaust port which communicates with the inflow passage at the part of the thermal reactor exhibiting insufficient thermal diffusion.

7 Claims, 5 Drawing Figures

EXHAUST GAS PURIFYING DEVICE

BACKGROUND OF THE INVENTION

The present invention relates to an exhaust gas purifying device, and more particularly to an improved assembly of a thermal reactor.

In general, the recombustion chamber of a thermal reactor is used at a high temperature in order to achieve a satisfactory effect of recombustion. Even when heat is insulated by covering with a heat insulting layer an inner core forming the recombustion chamber, the temperature of the surface of the case of a thermal reactor becomes high. Where the thermal reactor is mounted on a vehicle, the surface temperature should desirably be low so as to prevent other components from being adversely affected by the heat. For this reason, the thermal reactor is cooled by means of a fan for cooling an engine body as is provided in front of the engine body. It is usual, however, that the thermal diffusion in the case surface differs greatly in dependence on areas of the surface and that the surface temperature of the case varies in dependence on the areas. The difference of the thermal diffusion is attributed to the manners of flow of and exposure to wind from the cooling fan. Generally, the case surface temperature is much higher at the hinder part of the vehicle than at the fore part. In the case surface, a higher temperature portion and a lower temperature portion arise, and the extents of thermal expansion therefore differ. This brings about such disadvantage that the case, gasket etc. of the thermal reactor are prone to damage.

SUMMARY OF THE INVENTION

The principal object of the present invention is to make the occurrence of the recombustion of exhaust gas difficult at that part of a thermal reactor at which the thermal diffusion is little.

According to the present invention, the exhaust ports of an engine body and the corresponding inflow passages of a thermal reactor are caused to communicate, and the engine exhaust port opposite the inflow passage at the part of the thermal reactor with little thermal diffusion is limited in the supply of secondary air into it. Further, exhaust gas for use in an exhaust gas recirculating device is taken out from the vicinity of the exhaust port for limiting the secondary air.

DESCRIPTION OF THE PREFERRED EMBODIMENTS

Figure 1:
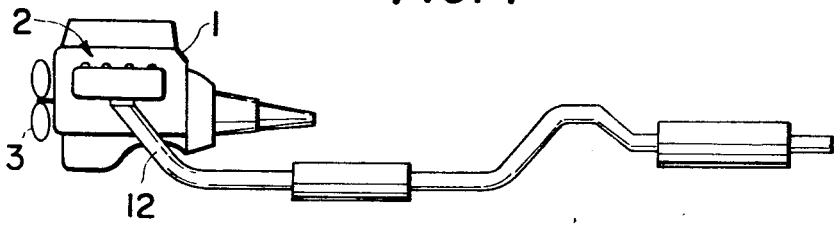
FIG. 1 is a schematic view of an internal combustion engine which has an exhaust gas purifying device embodying the present invention.
Figure 2:
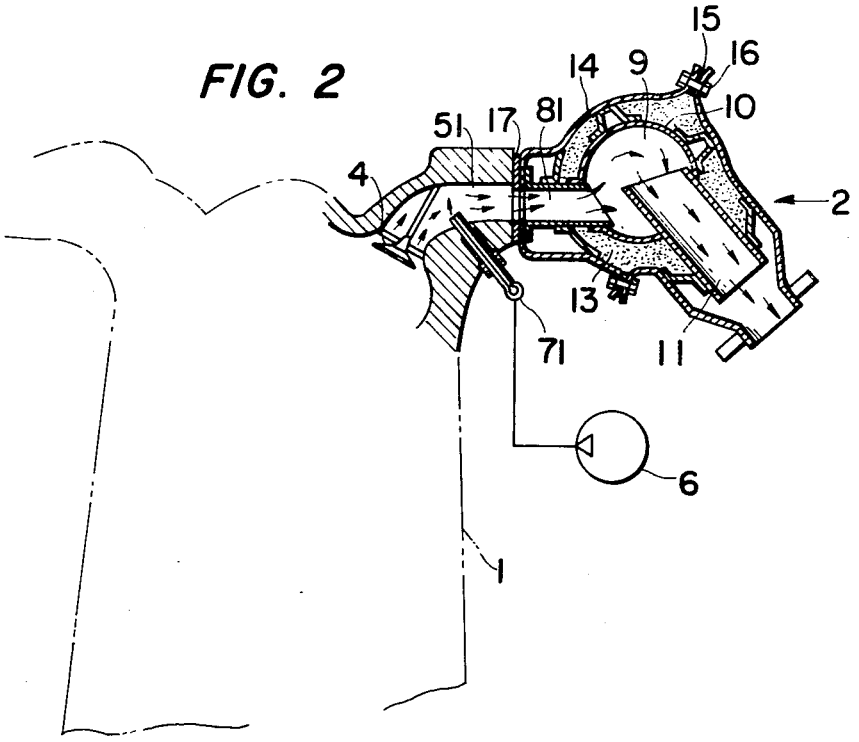
FIG. 2 is a cross-sectional view of the essential portions of the device.
Figure 3:
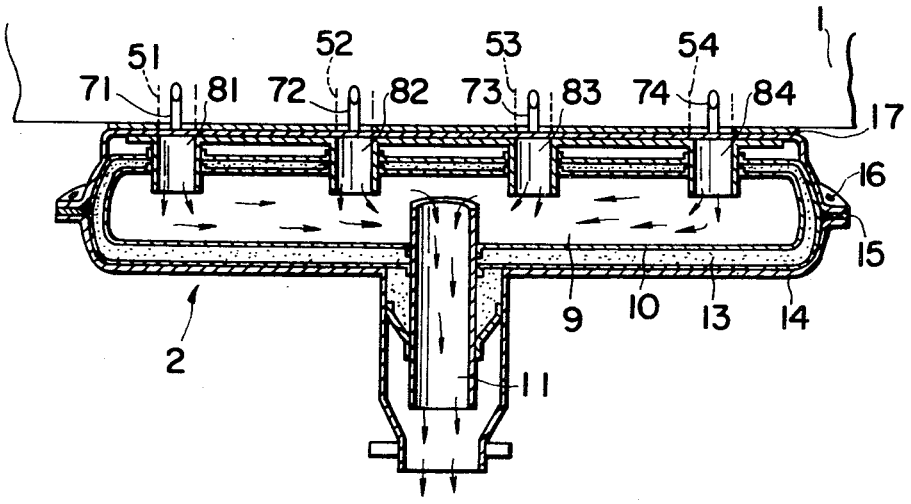
FIG. 3 is a longitudinal sectional view of the essential portions of the device.
Figure 4:
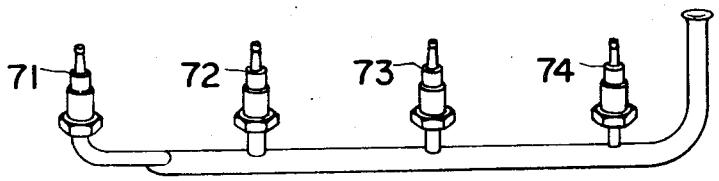
FIG. 4 is a perspective view showing secondary air injection nozzles.

Referring to FIGS. 1 to 4, a thermal reactor 2 for the recombustion of the exhaust gas of an engine body 1 is provided in the exhaust system of the engine body 1 so that its lengthwise direction may become the longitudinal direction of the engine body 1. In front of the engine body 1, a cooling fan 3 for cooling the thermal reactor 2 is provided. Air is sent from the front of the thermal reactor 2 towards the rear by means of the cooling fan 3. Although the thermal diffusion is good at the fore part of the thermal reactor 2, it is insufficient at the hinder part. The cylinder head portions of cylinders are respectively provided through exhaust valves 4 with exhaust ports 51, 52, 53 and 54 as viewed from /the front towards the rear of the engine. At the exhaust ports 51, 52, 53 and 54, secondary air injection nozzles 71, 72, 73 and 74 are respectively provided so that the secondary air may be supplied from an air pump 6. The diameter of the secondary air injection nozzle 74 is made smaller than the diameter of the other nozzles 71, 72 and 73 and, accordingly in the amount of injection of the secondary air. The outlets of the exhaust ports 51, 52, 53 and 54 are respectively caused to communicate with the inflow passages 81, 82, 83 and 84 of the thermal reactor 2. The respective inflow passages 81, 82, 83 and 84 are caused to communicate with a recombustion chamber 9 which is defined by an inner core 10. At the central part of the inner core 10 in the lengthwise direction, there is formed an opening, with which the outflow passage 11 of the thermal reactor 2 communicates. The exhaust gas burned in the recombustion chamber 9 again is emitted to the atmospheric air through an exhaust pipe 12 which communicates with the outflow passage 11. A heat insulating layer 13 of, for example, ceramic fiber is disposed at the outer periphery of the inner core 10. Further, the heat insulating layer 13, the inflow passages 81, 82, 83 and 84 and the outflow passage 11 are covered with a case 14. The case 14 can be divided into two parts, which are coupled by bolts 16 with gaskets 15 interposed therebetween. A gasket 17 is also disposed at the mounting portion between the thermal reactor 2 and the cylinder heads, that is, in the space between the case 14 and the cylinder heads. The heat insulating layer 13 of the ceramic fiber or the like may be substituted by thermal radiation shielding plates in the lamination of several layers.

With the exhaust gas purifying device thus constructed, and with the engine running, the exhaust gas flowing into the exhaust ports 51, 52, 53 and 54 through the exhaust valves 4 of the respective cylinders flows, together with the secondary air supplied thereinto through the corresponding secondary air injection nozzles 71, 72, 73 and 74 from the air pump 6, into the recombustion chamber 9 through the corresponding inflow passages 81, 82, 83 and 84 of the thermal reactor 2. An unburned component in the exhaust gas is burned in the recombustion chamber 9 again. The exhaust gas burned again is emitted to the atmospheric air through the outflow passage 11 as well as the exhaust pipe 12. In this case, that part in the thermal reactor 2 at which the thermal diffusion by the cooling fan 3 is insufficient, i.e., the part of the recombustion chamber 9 close to the inflow passage 84 is supplied with the less secondary air by the secondary air injection nozzle 74 than the other part is. At the former part, therefore, the recombustion does not take place considerably. Accordingly, less heat is generated due to the recombustion at the part of the thermal reactor 2 with the less thermal diffusion than at the other part, and the surface temperature of the thermal reactor 2 is made uniform.

Figure 5:
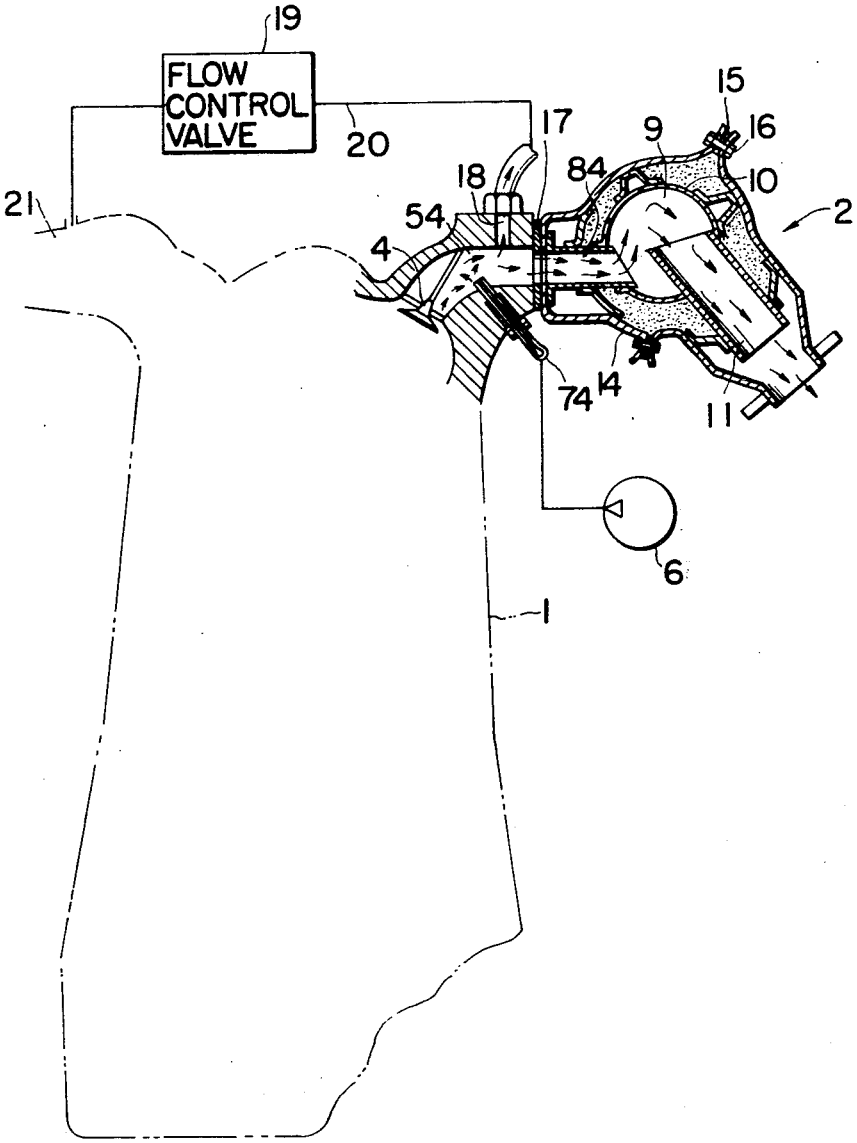
FIG. 5 is a cross-sectional view of the essential portions of an exhaust gas purifying device, showing another embodiment of the present invention.

Another embodiment will now be explained with reference to FIG. 5. In the embodiment, an exhaust gas taking-out port 18 for recirculating the exhaust gas is provided at the exhaust port 54 of the engine opposite the part of the thermal reactor 2 with the less thermal diffusion. Through a conduit 20 having a flow control valve 19, the exhaust gas taking-out port 18 communicates with a suction pipe 21 provided in the engine body 1. By recirculating the exhaust gas, nitrogen oxides in the exhaust gas are diminished. The remaining construction of the embodiment is the same as in the foregoing embodiment. The secondary air injection nozzles 71, 72 and 73 are respectively provided at the exhaust ports 51, 52 and 53, while the secondary air injection nozzle 74 smaller in the amount of injection of the secondary air than nozzles 71, 72 and 73 is provided at the exhaust port 54. The respective exhaust ports 51, 52, 53 and 54 communicate with the recombustion chamber 9 which is defined by the inner core 10. At the exhaust port 54 at which the exhaust gas taking-out port 18 is formed, the secondary air injection nozzle 74 may be dispensed with.

With the exhaust gas purifying device thus constructed, where the engine is operated, the exhaust gas within the exhaust ports 51, 52, 53 and 54 is mixed, as in the previous embodiment, with the secondary air introduced into the ports through the corresponding secondary air injection nozzles 71, 72, 73 and 74 from the air pump 6. The exhaust gas and the secondary air flow into the recombustion chamber 9 through the corresponding inflow passages 81, 82, 83 and 84 of the thermal reactor 2. In this case, at the exhaust port 54 opposite the part of the thermal reactor 2 with the less thermal diffusion, the exhaust gas is recirculated from the exhaust gas taking-out port 18 through the conduit 20 into the suction pipe 21. Therefore, the exhaust gas flowing into the recombustion chamber 9 through the inflow passage 84 of the thermal reactor 2 is of a smaller amount. The amount of the secondary air injected into the exhaust port 54 from the secondary air injection nozzle 74 is also smaller, so that considerably less secondary air is supplied into the inflow passage 84 than into passages 81, 82 and 83. In consequence, the recombustion does not take place considerably at the part of the recombustion chamber 9 near to the inflow passage 84, and the surface temperature of the thermal reactor 2 is made uniform. The uniform surface temperature of the thermal reactor 2 is achieved in such a way that the amount of exhaust gas taken out from the exhaust port 54 for the recirculation of the exhaust gas and the amount of secondary air supplied through the secondary air injection nozzle 74 into the exhaust port 54 are appropriately set, and the recombustion in the recombustion chamber 9 is appropriately limited. In the vicinity of the inflow passage 84 in the thermal reactor 2, the amount of supply of the secondary air is lessened, so that an unburned component in the exhaust gas is emitted without being burned again. Since, however, the generation of nitrogen oxides is prevented by recirculating the exhaust gas into the suction pipe 21, the exhaust gas purification is preferable as a whole. In general, where the secondary air is injected at the cylinder head and the exhaust gas for the exhaust gas recirculating device is taken out from the cylinder head, the exhaust gas to be recirculated contains therein the secondary air component in large quantities (usually by 40 – 50 %). In contrast, in the device according to the present invention, the amount of the secondary air from the secondary air injection nozzle 74 is limited, and hence, the secondary air component in the exhaust gas to be recirculated is of 5 – 10 %.

While, in the foregoing embodiments, the engine having four cylinders has been referred to, the present invention can be likewise applied to an engine having a different number of cylinders. The amounts of secondary air injection of the secondary air injection nozzles may be gradually limited from the part of the thermal reactor with sufficient thermal diffusion towards the part with insufficient thermal diffusion. Similarly, the amounts of recirculation exhaust gas to be taken out may be gradually regulated at the respective exhaust ports.

As described above, according to the thermal reactor of the present invention, the amount of supply of the secondary air is made smaller or the amount of the exhaust gas flowing into the thermal reactor is made smaller at the part exhibiting the less thermal diffusion, whereby the recombustion is lessened so as to prevent a temperature difference from arising in dependence on the surface area of the thermal reactor. Since, in this manner, the thermal reactor has no part of especially high temperature, the case of the thermal reactor, the gasket disposed therein, etc. are difficult to be damaged, and the selection of their materials is easy. In addition, the amounts of the secondary air to be supplied to the exhaust ports of the engine and the amount of the recirculating exhaust gas to be taken out from the exhaust port are regulated, whereby the reduction of nitrogen oxides in the exhaust gas and the recombustion of the unburned component are achieved. The device is therefore favorable for the purification of the exhaust gas.

What I claim is:

1. An internal combustion engine comprising:

a group of cylinders each having an exhaust port, a housing defining a recombustion chamber therein, a source of coolant adjacent said recombustion chamber, gas passages connecting each exhaust port to said recombustion chamber, each of said passages having an inlet end connected to a respective one of the exhaust ports and an outlet end opening directly into said recombustion chamber immediately adjacent the periphery of said housing, all of said outlet ends terminating substantially the same distance, if any, from the periphery of said housing, said gas passages being spaced different distances from said source, means for injecting air into the gas passages, said means injecting less air into the gas passage most distant from said source than into the gas passage most adjacent said source so that less recombustion occurs and less heat is generated in the portion of the recombustion chamber most remote from the source where there is less thermal diffusion by the source than the portion thereof most adjacent the source where there is sufficient thermal diffusion by the source whereby the surface temperature of the recombustion chamber is substantially uniform.

2. The internal combustion engine of claim 1 wherein:

an exhaust gas taking-out port is connected to the exhaust port most distant from the source, and said exhaust gas taking-out port is connected to a suction system of the engine.

3. The internal combustion engine of claim 1 wherein:

said means comprises air injection nozzles.

4. The internal combustion engine of claim 3 wherein:

each one of said nozzles communicates with a respective one of said exhaust ports.

5. The internal combustion engine of claim 4 wherein:

the nozzle which communicates with the exhaust port most distant from the source has a smaller cross-sectional area than the cross-sectional area of each of the other nozzles.

6. The internal combustion engine of claim 4 wherein:

the nozzles are circular in cross-section and the nozzle which communicates with the exhaust port most distant from the source has a smaller diameter than the diameter of each of the other nozzles.

7. The internal combustion engine of claim 1 wherein:

said source comprises a fan.

* * * * *